US010589527B2

(12) United States Patent
Dowell et al.

(10) Patent No.: US 10,589,527 B2
(45) Date of Patent: Mar. 17, 2020

(54) LIQUID ADSORPTION

(71) Applicant: Hewlett-Packard Development Company, L.P., Houston, TX (US)

(72) Inventors: Daniel D. Dowell, Corvallis, OR (US); Minalben Bhavin Shah, Vancouver, WA (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/763,853

(22) PCT Filed: Dec. 21, 2015

(86) PCT No.: PCT/US2015/067123
§ 371 (c)(1),
(2) Date: Mar. 28, 2018

(87) PCT Pub. No.: WO2017/111908
PCT Pub. Date: Jun. 29, 2017

(65) Prior Publication Data

US 2018/0290448 A1 Oct. 11, 2018

(51) Int. Cl.

| | |
|---|---|
| ***B41J 2/14*** | (2006.01) |
| ***B41J 2/175*** | (2006.01) |
| ***B41J 2/19*** | (2006.01) |
| ***B41J 29/13*** | (2006.01) |
| ***B41J 2/16*** | (2006.01) |

(52) U.S. Cl.
CPC ..... *B41J 2/1433* (2013.01); *B41J 2/162* (2013.01); *B41J 2/164* (2013.01); *B41J 2/175* (2013.01); *B41J 2/17503* (2013.01); *B41J 2/19* (2013.01); *B41J 29/13* (2013.01)

(58) Field of Classification Search
CPC . B41J 2/175; B41J 2/1433; B41J 2/164; B41J 2/162
USPC ..... 347/45, 47, 85
See application file for complete search history.

(56) References Cited

U.S. PATENT DOCUMENTS

| | | | |
|---|---|---|---|
| 4,509,062 | A | 4/1985 | Low et al. |
| 5,682,186 | A | 10/1997 | Bohorquez et al. |
| 5,875,615 | A | 3/1999 | Ito et al. |
| 5,917,523 | A | 6/1999 | Baldwin et al. |
| 5,988,806 | A | 11/1999 | Hall et al. |
| 6,293,665 | B1 | 9/2001 | Pew et al. |
| 6,533,405 | B1 | 3/2003 | Sleger |

(Continued)

FOREIGN PATENT DOCUMENTS

| | | |
|---|---|---|
| CN | 1385305 | 12/2002 |
| CN | 102029786 | 4/2011 |

(Continued)

*Primary Examiner* — An H Do
(74) *Attorney, Agent, or Firm* — HP Inc. Patent Department

(57) ABSTRACT

Example implementations relate to liquid adsorption. In an example, a liquid adsorption system includes a vapor barrier container having a sealable internal volume, a liquid dispensing device in the internal volume, where the liquid dispensing device includes liquid in a liquid flow path extending through at least a portion of the liquid dispensing device to an opening in communication with the internal volume, and a liquid adsorbing material in the internal volume.

14 Claims, 4 Drawing Sheets

(56) References Cited

U.S. PATENT DOCUMENTS

| | | | | |
|---|---|---|---|---|
| 6,642,061 | B2 | 11/2003 | Ellson et al. | |
| 7,044,588 | B2 | 5/2006 | Tajima et al. | |
| 8,596,746 | B2 * | 12/2013 | Curcio ..... | B41J 2/1707 347/20 |
| 2006/0215000 | A1 | 9/2006 | Kachi | |
| 2007/0273735 | A1 | 11/2007 | Ujita et al. | |
| 2008/0065325 | A1 | 3/2008 | Geelen et al. | |
| 2011/0074872 | A1 | 3/2011 | Ozaki et al. | |
| 2011/0310181 | A1 | 12/2011 | Curcio et al. | |

FOREIGN PATENT DOCUMENTS

| | | |
|---|---|---|
| CN | 102378691 | 3/2012 |
| JP | S6219460 | 1/1987 |
| JP | 06-316086 | 11/1994 |
| WO | WO-2010114516 | 10/2010 |

* cited by examiner

LIQUID ADSORPTION

BACKGROUND

Liquid dispensers such as printhead assemblies may be transported in a filled condition with liquid present in the liquid dispenser. To mitigate and/or prevent liquid in the dispenser from vaporizing the dispensers may be transported in a container having vapor barrier properties.

DETAILED DESCRIPTION

Figure 1:
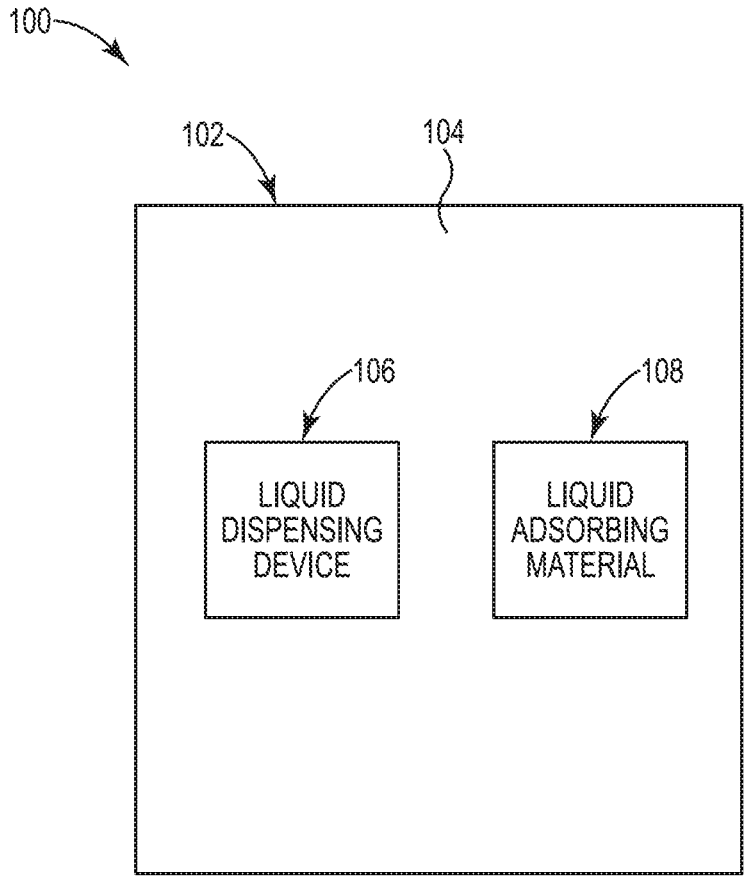
FIG. 1 is a block diagram of an example of liquid adsorption system according to the disclosure.

Liquid dispensing devices such as printheads and/or printhead assemblies may be shipped to end users and/or points of sale from a location of manufacture and/or packaging of the liquid dispensing devices. Liquid dispensing devices may include liquid when shipped. For example, manufacture of liquid dispensing devices can include at least partially filling an internal volume of the liquid dispensing device with a liquid. The liquid may include an amount of air and/or cause air to be trapped in a liquid dispensing device. A liquid dispensing device including liquid and an amount of air may be at least partially sealed (e.g., by sealing a liquid inlet of the liquid dispensing device) prior to shipping and remain sealed until being unsealed by an end user or other individual at an end location.

However, end users and/or a point of sale may be at different altitudes and/or temperatures and therefore different ambient pressures than an ambient pressure at a location of manufacture and/or packaging of a liquid dispensing device. As a result, a liquid dispensing device may experience changes in pressure during shipment to and/or upon arrival at an end location of a customer and/or a point of sale.

For example, a liquid dispensing device may experience a comparative decrease in pressure. In such an example, the liquid dispensing device may be prone to unintended output of liquid contained in the liquid dispensing device when an end user attempts to initially use and/or unseal a partially sealed liquid dispensing device. Such unintended output of the liquid may at least in part be attributed to expansion of air included in the liquid dispensing device. Air may be included prior to, during, and/or following filling a liquid dispensing device with liquid. Air entrained in liquid included or otherwise included in a liquid dispensing device may expand due to a pressure differential between an ambient pressure at an end location and an ambient pressure at a location of manufacture and/or packaging of the liquid dispensing device. That is, such expansion may result in unintended output of liquid contained in the liquid dispensing device.

Accordingly, examples of the disclosure relate to liquid adsorption. In an example, a liquid adsorption system can include a vapor barrier container having a sealable internal volume, a liquid dispensing device in the internal volume, where the liquid dispensing device includes liquid in a liquid flow path extending through at least a portion of the liquid dispensing device to an opening in communication (e.g., liquid vapor communication) with the internal volume, and a liquid adsorbing material in the internal volume. As described herein, liquid adsorption can mitigate and/or eliminate a pressure differential between an ambient pressure (e.g., at an end user location) and an internal pressure in a liquid dispensing device so air included in liquid in the liquid dispensing device is permitted to change size (e.g., expand). Such expansion can mitigate and/or eliminate unintended liquid output by the liquid dispensing device.

FIG. 1 is a block diagram of an example of liquid adsorption system according to the disclosure. As illustrated in FIG. 1, the system 100 can include a liquid barrier container 102, a liquid dispensing device 106, and a liquid adsorbing material 108.

The liquid barrier container 102 can be bag, box, and/or other type of container having a sealable internal volume and liquid barrier properties, as described herein. The liquid barrier container 102 can form a liquid barrier (e.g., a liquid vapor barrier). For instance, in various examples, the liquid barrier container can be a vapor barrier bag. A liquid barrier container such as a vapor barrier bag can be formed of and/or coated with a material to provide liquid barrier properties, as described herein. For example, a liquid barrier container such as a vapor barrier bag can be formed of multiple layers of metalized polyester and heavy gauge dissipative polyethylene and/or other suitable material to provide liquid vapor barrier properties and/or a desired water vapor transmission rate.

The liquid barrier container 102 can be sealed by physical manipulation of the liquid barrier container, a sealant, an adhesive, and/or application of a mechanical fastener, among other possibilities. That is, liquid barrier container 102 has a sealable internal volume that can be sealed to form a sealed internal volume 104, as illustrated in FIG. 1. The liquid barrier container 102 and the internal volume 104 can be liquid vapor and/or pressure sealed from an ambient environment external to the liquid barrier container 102. For instance, the liquid barrier container 102 when sealed can have a vapor transmission rate of less than ten milligrams per day. However, other values of vapor transmission (e.g., values less than ten milligrams of vapor and/or liquid per day) are possible. The liquid barrier container may be sealed at a pressure equal to a pressure at a location of manufacture and/or packaging (e.g., sealing) of the liquid barrier container 102.

As illustrated in FIG. 1, the liquid dispensing device 106 and the liquid adsorbing material 108 can be located in the internal volume 104 of the liquid barrier container 102. The liquid dispensing device 106 and the liquid adsorbing material 108 are separate and distinct. For instance, the liquid adsorbing material 108 can be disposed outside of the liquid dispensing device 106 when the liquid adsorbing material 108 and the liquid dispensing device 106 are located in the internal volume 104.

The liquid dispensing device 106 refers to a device that includes liquid and is to selectively dispense the liquid. Examples of liquid dispensing devices include printheads and/or printhead assemblies. In some examples, the liquid dispensing device 106 can be a printhead and/or printhead assembly including nozzles (not shown for ease of illustration). For example, the liquid dispensing device 106 can be a printhead with nozzle arrays having a resolution of at least 600 nozzles per inch, among other possibilities. The nozzles refer to openings in communication with an environment surrounding the liquid dispensing device 106.

The nozzles may permit egress of vapor from the liquid dispensing device 106 to the internal volume 104. That is, in various examples, the liquid dispensing device 106 includes an opening in communication with an environment such as the internal volume 104 surrounding the liquid dispensing device. For example, the opening may be in vapor communication with an environment surrounding the liquid dispensing device to permit egress of vapor from the liquid dispensing device 106 to the environment surrounding the liquid dispensing device 106. In some examples, the opening can be formed of at least one nozzle. Put another way, the opening can be formed of at least one nozzle of a plurality of nozzles in the liquid dispensing device 106.

The liquid dispensing device 106 can be partially sealed. For example, following manufacture and/or partially filling the liquid dispensing device 106 with liquid a liquid inlet (i.e., a liquid interconnect) can be sealed. The liquid inlet can be sealed by a layer of material, a plug or other physical obstruction, an adhesive, and/or a sealant, among other possibilities, while at least one opening in the liquid dispensing device 106 remains unsealed. Put another way, the liquid dispensing device 106 can be partially sealed (e.g., partially liquid and/or pressure sealed) such that the liquid dispensing device is sealed except for at an opening (e.g., a nozzle) of the liquid dispensing device 106. As described herein, maintaining at least one opening in the sealed liquid dispensing device 106 in communication with an environment (e.g., the internal volume 104) external to the liquid dispensing device 106 can promote liquid adsorption.

The liquid adsorption material 108 refers to material having an ability to adsorb vapor such as water vapor. Examples of suitable liquid adsorption materials include silica based materials, montmorillonite clay, synthetic zeolite, calcium oxide, and/or calcium sulfate, among other types of liquid adsorption materials.

The liquid adsorbing material 108 can have a liquid adsorption capacity as measured in accordance with Mil-D-3464E, among other relevant standards, from 0.1% and 5.0% of a total volume of the liquid in a liquid dispensing device. All individual values and subranges from 0.1% to 5.0% a total volume of the liquid in the liquid dispensing device are included; for example, the adsorption capacity can have from a lower limit of 0.1%, 0.5%, or 1.0% to an upper limit of 5.0%, 4.5%, or 3.5% of adsorption capacity. In some examples, the adsorption capacity can be from 0.6% to 3.6% of a total volume of the liquid in a liquid dispensing device.

In some examples, the liquid adsorbing material 108 can have a liquid adsorbing efficiency as measured in accordance with Mil-D-3464E, among other relevant standards, of at least 0.24 grams of liquid per gram of the liquid adsorbing material 108. For example, the liquid adsorbing material 108 can have a liquid adsorbing efficiency from 0.24 grams of liquid to 0.6 grams of the liquid per gram of the liquid adsorbing material 108. All individual values and subranges from 0.24 grams to 0.6 grams are included.

As mentioned, the liquid dispensing device 106 can include liquid. The liquid can be a water-based printing liquid, among other suitable types of liquid employable by liquid dispensing devices.

In various examples, the liquid adsorbing material 108 in the internal volume 104 can adsorb at least a predetermined portion of a liquid present in the liquid dispensing device. The liquid present in the liquid dispensing device refers to an amount of liquid present in the liquid dispensing device when the liquid dispensing device is at least partially filled with liquid. For example, the liquid dispensing device 106 can be filled with ten milliliters of liquid to at least partially fill the liquid dispensing device 106. In such an example, the predetermined amount of liquid can be equal to 0.5 milliliters to 2 milliliters of the 10 milliliters. However, the disclosure is not so limited. Rather an amount of liquid in the liquid dispensing device and/or a predetermined portion of the amount of liquid in the liquid dispensing device can be varied independent of each other. For example, a predetermined amount can be a particular percentage and/or a particular amount of liquid of a total amount of liquid in the liquid dispensing device.

In any case, having liquid adsorbing material 108 in the internal volume 104 to adsorb at least a predetermined portion of the liquid in the liquid dispensing device 106 can mitigate and/or eliminate a pressure differential between an ambient pressure (e.g., at an end location) and an internal pressure in the liquid dispensing device 106 so air included in liquid in the liquid dispensing device is permitted to change size (e.g., expand) and thereby mitigate and/or eliminate unintended liquid output by the liquid dispensing device 106.

In some examples, the predetermined amount of liquid can be equal to a difference between an estimated volume of the air bubble associated with a first location and an estimated volume of the air bubble associated with a second location such as an end location. That is, a location of an end user and/or point of sale may be known and a location of manufacture/packaging of the liquid dispensing device 106 may be known.

As mentioned, an estimated volume of the air bubble associated with a first location can be determined. The first location can be a location of manufacture and/or packaging of the liquid dispensing device 106. An estimated volume of the air bubble associated with a second location can be determined. The second location can be a location of an end user and/or a point of sale of a liquid dispensing device. Determination of such volumes of an air bubble can promote liquid adsorption (e.g., to indicate an amount of liquid in the liquid dispensing device 106 that is to be adsorbed to negate and/or mitigate an ambient pressure differential between the first location and the second location). An estimated volume of the air bubble can be a function of a temperature and/or a pressure at a particular location, among other items.

In some examples, an estimated time of transit (i.e., shipping) of a packed liquid dispensing device from a first location to a second location can be determined. An estimated time of transit can be used to indicate an amount of liquid to be adsorbed to negate and/or mitigate an ambient pressure differential between the first location and the second location. For example, a comparatively longer estimated transit time and/or time until purchase/use by an end user may result in a greater predetermined amount of liquid than a comparatively shorter transit time. Accordingly, an estimated transit time and/or a difference between an estimated volume of the air bubble associated with a first location and an estimated volume of the air bubble associated with a second location can be used to predetermine an amount of liquid to be adsorbed by and/or an amount of adsorbing material to adsorb the predetermined amount of liquid.

The liquid dispensing device 106 and the liquid adsorbing material 108 can be located in the internal volume 104 of the liquid barrier container 102. This arrangement can be referred to as a packaged liquid dispensing device. That is, a packaged liquid dispensing device can, in various examples, include a vapor barrier bag (e.g., having a water vapor transmission rate of less than ten milligrams per day), a liquid dispensing device in the vapor barrier bag, where the liquid dispensing device includes a liquid flow path extending through the liquid dispensing device to an opening in communication with the internal volume, where the liquid flow path includes a sealed portion, a liquid including an air bubble in the liquid flow path, and a liquid adsorbing material in the internal volume to adsorb at least a predetermined portion of the liquid, as described herein.

Figure 2:
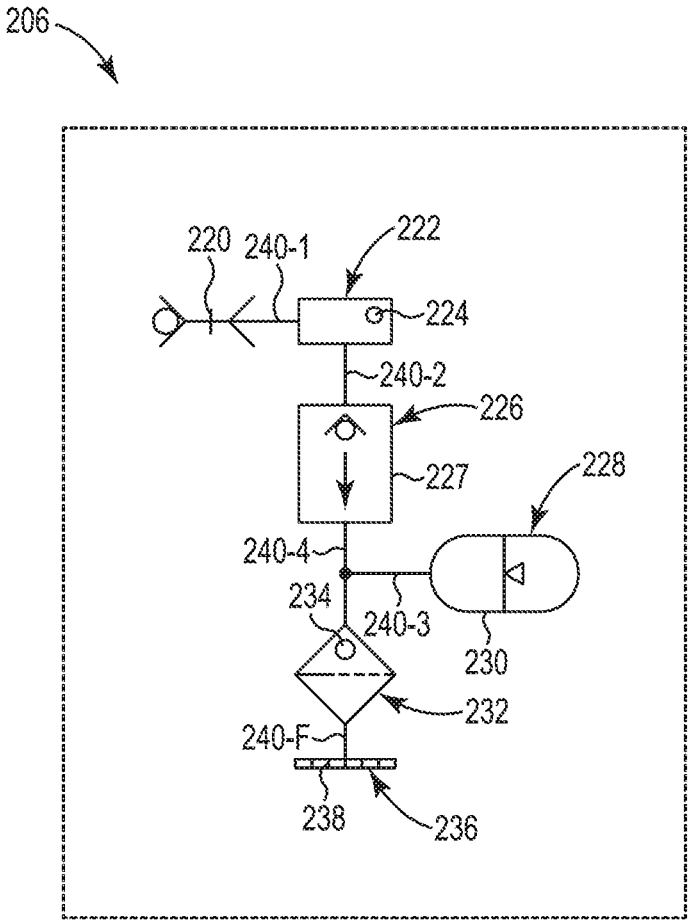
FIG. 2 illustrates an example of a liquid dispensing device according to the disclosure.
Figure 3:
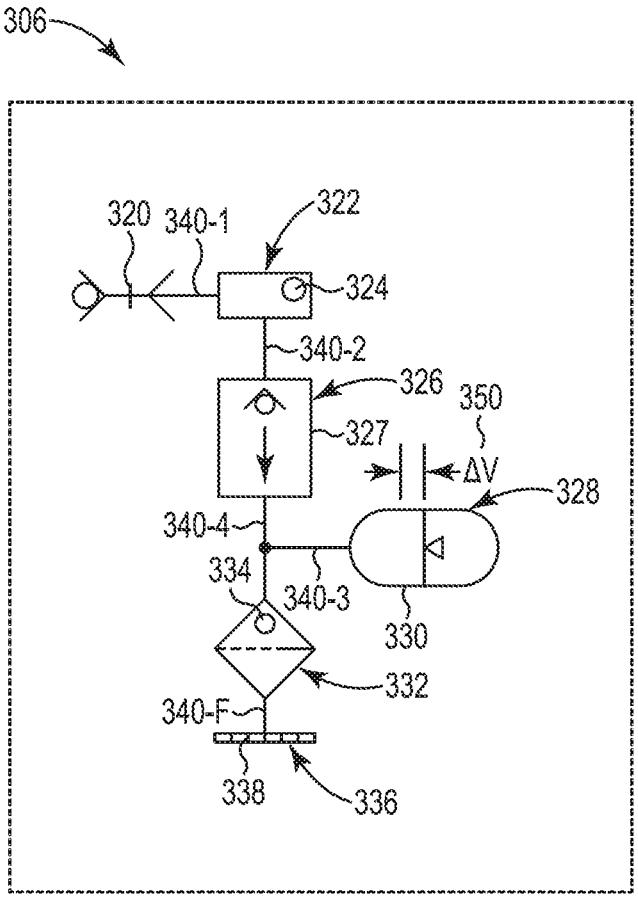
FIG. 3 illustrates an example of a liquid dispensing device according to the disclosure.

FIGS. 2 and 3 illustrate examples of a liquid dispensing device according to the disclosure. FIG. 2 illustrates an example of a liquid dispensing device 206 according to the disclosure having an air bubble 224 included in the liquid dispensing device 206 at a first volume (e.g., an unexpanded volume). As illustrated in FIG. 2, the liquid dispensing device 206 can include a liquid inlet 220, a chamber 222, a backpressure regulator 226, an accumulator 228, a filter 232, and a printhead 236 including nozzles 238.

In various examples, the liquid dispensing device 206 can be a printhead assembly. For example, a printhead assembly can include a printhead with nozzles such as printhead 236 (e.g., nozzle arrays having a resolution of at least 600 nozzles per inch), a sealed liquid inlet (i.e., a liquid interconnect) such as liquid inlet 220 at the opposite end of the liquid dispensing device from the nozzles, a chamber downstream (i.e., along an intended direction of flow of liquid 227) of the liquid inlet 220, and a backpressure regulator such as the backpressure regulator 226, among other possible components.

The liquid inlet 220 can include and/or be formed by a needle valve, among other types of valves and/or inlets to permit liquid into the liquid dispensing device 206. As mentioned, the liquid inlet 220 can be sealed. As mentioned, the liquid inlet 220 and therefore the liquid barrier container 206 can be sealed by physical manipulation of the liquid inlet (e.g., adjusting a valve position), a sealant, an adhesive, and/or application of a mechanical fastener (e.g., a plug), among other possibilities. For example, the liquid inlet 220 can be sealed in response to at least partially filling the liquid dispensing device 206 with liquid, as described herein.

The chamber 222 refers to a volume of space included in and/or in communication with the liquid flow path 240. As illustrated in FIG. 2, the chamber can be positioned along the liquid flow path between the liquid inlet 220 and the backpressure regulator 226. The chamber can include liquid containing an air bubble 224.

The backpressure regulator 226 refers to a valve that can maintain a desired internal pressure (e.g., an internal pressure of a sealed portion of the liquid dispensing device) during transport and/or operation of the liquid dispensing device. The backpressure regulator can be formed of a one-way valve to permit liquid flow along a liquid flow path, as described herein, in an intended direction.

The liquid flow path 240 can be formed of liquid conduits 240-1, 240-2, 240-3, 240-4, . . . , 240-F and various components included in the liquid dispensing device (e.g., the liquid inlet 220, the chamber 222, the backpressure regulator 226, the accumulator 228, the filter 232, and/or the printhead 236 including the nozzles 238). The liquid flow path 240 can extend at least partially through the liquid dispensing device 206. For example, the liquid flow path 240 can extend from the liquid inlet 220 to an opening in communication with the internal volume. In various examples, the liquid flow path 240 can extend from the liquid inlet 220 to the nozzles 238 positioned at an opposite end of the liquid flow path, as illustrated in FIG. 2.

The liquid flow path 240 can include a sealed portion and a partially sealed portion. For example, during transit to an end user the sealed portion and the partially sealed portion can remain sealed and partially sealed, respectively. The sealed portion can include a portion of the flow path 240 (e.g., 240-1 and/or 240-2) located upstream from the backpressure regulator 226 and/or a component ( ) located upstream from the backpressure regulator 226. The partially sealed portion can include a different portion of the flow path 240 (e.g., 240-3, 240-4, and/or 240-F) located downstream from of the backpressure regulator along an intended direction of flow of liquid 227 in the liquid dispensing device.

In various examples, the partially sealed portion can be partially sealed by a meniscus formed by liquid from the liquid dispensing device at an opening (e.g., the nozzles 238) located at an end of the partially sealed portion. For example, the liquid dispensing device can be at least partially filled (e.g., at least partially filling the liquid flow path 240) with a water-based printing liquid. In such an example, an opening such as the nozzles 238 can be sized to permit the water-based printing liquid to form a meniscus at the opening. Put another way, an internal diameter of the opening (e.g., the nozzles 238) can be a particular dimension to promote formation of a meniscus at the opening. The particular dimension can be varied based on a type of liquid, an amount of liquid, and/or an estimated pressures such as an estimated ambient pressure during transport of the liquid dispensing device, among other possibilities to promote formation of a meniscus and/or otherwise promote liquid adsorption, as described herein.

Notably, an air bubble such as air bubble 234 included in the partially sealed portion of the liquid dispensing device can be permitted to change size (e.g., expand) during transit of the liquid printing device 206 in accordance with ambient pressure changes. However, an air bubble such as air bubble 224 included in the sealed portion may under some circumstances not change volume during transit of the liquid printing device 206 due at least in part to being included in the sealed portion of the liquid dispensing device unless a volume of liquid is permitted to be output from the sealed portion.

As mentioned, backpressure regulator 226 can, during transit of the liquid dispensing device, among other scenarios such as during operation, permit liquid to flow from the sealed portion of the liquid dispensing device 206 to the partially sealed portion of the liquid dispensing device 206. The partially sealed portion can permit liquid vapor to egress through a meniscus at an opening to an internal volume of a liquid barrier container. In this manner, a volume of liquid output from the sealed portion to the partially sealed portion can promote air bubble 224 to vary in size during transit.

The accumulator 228 refers to a volume including liquid 230 in communication with the liquid flow path 240. The accumulator 228 can include a variable amount of liquid. As detailed herein, the amount of liquid in the accumulator 228 can vary (e.g., decrease) in response to and/or to permit liquid adsorption. The filter 232 refers to a particulate filter or other type of filter that is in-line with a flow of liquid along the liquid flow path or otherwise filters particulates or other substances from liquid in the liquid dispensing device.

FIG. 3 illustrates an example of a packaged liquid dispensing device 306 according to the disclosure having an air bubble 324 included in the liquid dispensing device 306 at a second volume (e.g., an expanded volume) that is different than the first volume of the bubble.

The liquid dispensing device 306 can include a liquid inlet 320, a chamber 322, a backpressure regulator 326, an accumulator 328, a filter 332, and a printhead 336 including nozzles 338. The liquid inlet 320, the chamber 322, the backpressure regulator 326, the accumulator 328, the filter 332, and/or the printhead 336 including the nozzles 338 can be analogous to the liquid inlet 220, the chamber 222, the backpressure regulator 226, the accumulator 228, the filter 232, and/or the printhead 236 including the nozzles 238, respectively, as described with respect to FIG. 2. Similarly, liquid flow path 340 (e.g., formed of 340-1, 340-2, 340-3, 340-4, . . . , 340-F) can be analogous to liquid flow path 204.

As illustrated in FIG. 3, the liquid dispensing device 306 can include a bubble 324 in a second state different than a first state. For instance, as shown in FIG. 3, the air bubble 324 can be an expanded state as compared to an unexpanded state illustrated in FIG. 2. As mentioned, expansion of the air bubble 324 can be permitted by adsorption of at least some liquid included in the liquid dispensing device 306 by liquid adsorbing material. A total amount of liquid in the liquid dispensing device can decrease due to adsorption of liquid by the liquid adsorbing material. For example, the total amount of liquid can decrease by an amount that is equal to a change 350 in an amount of liquid 330 in the accumulator 328.

For example, a change in the amount of liquid 350 can be equal to an amount of a change in volume of the bubble 334 and/or a change in volume of a bubble 334. The decrease in liquid can be equal to an amount of liquid that evaporates through opening 338. For example, liquid can evaporate from a meniscus formed in the opening 338 to promote liquid adsorption by maintaining a constant or near constant internal pressure that is comparatively less than an ambient pressure surrounding the liquid dispensing device 306 and/or an ambient pressure surrounding a liquid barrier container in which the liquid dispensing device is packaged.

Figure 4:
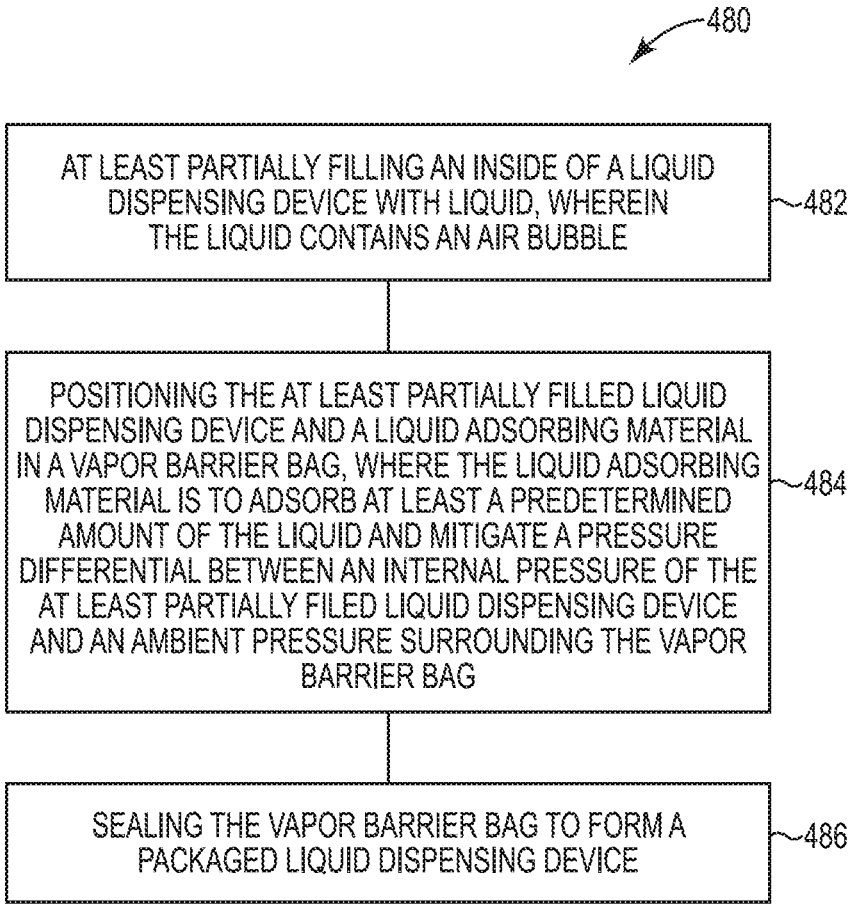
FIG. 4 is a flow chart illustrating an example of a method of liquid adsorption according to the disclosure.

FIG. 4 is a flow chart illustrating an example of a method of liquid adsorption according to the disclosure. At 482, the method 480 can include at least partially filling an inside of a liquid dispensing device with liquid, where the liquid contains an air bubble, as described herein. As mentioned, filling a liquid dispensing device can occur following manufacture of the liquid dispensing device and in advance of shipment of the liquid dispensing device to an end user and/or a point of sale to an end user. A liquid flow path and/or a variety of components of the liquid dispensing device can be at least partially filled. For example, a volume of a liquid flow path extending at least partially through a liquid dispensing device (e.g., extending from a liquid inlet to an opening in the liquid flow device) can be entirely filled or partially filled.

At 484, the method 480 can include positioning the at least partially filled liquid dispensing device and a liquid adsorbing material in a vapor barrier bag or other liquid barrier container suitable for liquid adsorption. Positioning refers to placement of and/or causing the placement of the liquid dispensing device and/or the liquid adsorbing material in an internal volume of a vapor barrier bag or other suitable liquid barrier container for liquid adsorption. In various examples, the liquid adsorbing material is to adsorb at least a predetermined amount of the liquid, as described herein. As mentioned, such adsorption of liquid can mitigate a pressure differential between an internal pressure of the at least partially filed liquid dispensing device and an ambient pressure surrounding the vapor barrier bag.

The method 480 can include sealing the vapor barrier bag to form a packaged liquid dispensing device, as illustrated at 486. As described herein, a packaged liquid dispensing device refers to a liquid dispensing device (e.g., a partially sealed liquid dispensing device) and a liquid adsorbing material positioned in a sealed liquid barrier container such as a sealed vapor barrier bag. In some examples, the method 480 can include sealing the liquid barrier container in response to positioning the liquid dispensing device and the liquid adsorbing material in the vapor barrier bag or other liquid barrier container.

In some examples, the method 480 can include unpacking a packaged liquid dispensing device. Unpacking refers to unsealing a sealed vapor barrier bag or other sealed liquid barrier container and removing a partial seal (e.g., a seal at a liquid inlet) of a sealed liquid dispensing device. In some examples, prior to unpacking an air bubble can expand. Such expansion can follow and/or be facilitated by a liquid adsorbing material adsorbing an amount of liquid. As a result of expansion, a pressure of the air bubble in the liquid can be comparatively lower prior to and/or during unpacking than a pressure of the air bubble when the liquid dispensing device is positioned and/or sealed in the vapor barrier bag.

As used herein. "a" or "a number of" something can refer to one or more such things. When an element is referred to as being "on," "connected to", "coupled to", or "coupled with" another element, it can be directly on, connected, or coupled with the other element or intervening elements may be present.

Since many examples can be made without departing from the spirit and scope of the system and method of the disclosure, this specification merely sets forth some of the many possible example configurations and implementations. In the disclosure, reference is made to the accompanying drawings that form a part hereof, and in which is shown by way of illustration how a number of examples of the disclosure can be practiced. These examples are described in sufficient detail to enable those of ordinary skill in the art to practice the examples of this disclosure, and it is to be understood that other examples can be used and that process, electrical, and/or structural changes can be made without departing from the scope of the disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the disclosure. In addition, the proportion and the relative scale of the elements provided in the figures are intended to illustrate the examples of the disclosure, and should not be taken in a limiting sense.

What is claimed:

1. A liquid adsorption system, comprising:

a vapor barrier container having a sealable internal volume;

a liquid dispensing device in the internal volume, wherein the liquid dispensing device includes a nozzle and liquid in a liquid flow path extending through at least a portion of the liquid dispensing device to an opening in communication with the internal volume; and a liquid adsorbing material in the internal volume, wherein the liquid adsorbing material has a liquid adsorption efficiency of at least 0.24 grams of liquid per gram of the liquid adsorbing material.

2. The system of claim 1, wherein the liquid dispensing device is a printhead including the nozzle and another nozzle.

3. The system of claim 2, wherein the opening comprises at least one nozzle of the nozzles.

4. The system of claim 2, wherein the printhead is liquid sealed except for at the nozzles.

5. The system of claim 1, wherein the liquid adsorbing material has an adsorption capacity of between 0.1% and 5.0% of a total volume of the liquid in the liquid dispensing device.

6. The system of claim 1, wherein the liquid is a water-based printing liquid, and wherein the opening is sized to permit the water-based printing liquid to form a meniscus at the opening.

7. A packaged liquid dispensing device, comprising:

a vapor barrier bag having a water vapor transmission rate of less than ten milligrams of water vapor per day;

a liquid dispensing device in the vapor barrier bag, wherein the liquid dispensing device includes a nozzle and a liquid flow path extending through the liquid dispensing device to an opening in communication with an internal volume of the vapor barrier bag, wherein the liquid flow path includes a sealed portion;

a liquid including an air bubble in the liquid flow path, wherein the air bubble is in the sealed portion of the liquid flow path; and a liquid adsorbing material in the internal volume to adsorb at least a predetermined portion of the liquid.

8. The packaged liquid dispensing device of claim 7, wherein the liquid dispensing device is a printhead assembly comprising:

a printhead with nozzle arrays having a resolution of at least 600 nozzles per inch;

a sealed liquid inlet at the opposite end of the liquid dispensing device from the printhead;

a chamber downstream of the sealed liquid inlet; and a backpressure regulator.

9. The package liquid dispensing device of claim 7, wherein the predetermined portion of liquid is equal to a difference between an estimated volume of the air bubble associated with a first location and an estimated volume of the air bubble associated with a second location.

10. The packaged liquid dispensing device of claim 7, wherein liquid flow path extends from a sealed liquid interconnect to nozzles at an end of the liquid flow path from the sealed liquid interconnect.

11. The packaged liquid dispensing device of claim 7, wherein the liquid adsorbing material is positioned outside of the liquid dispensing device.

12. A method, comprising:

at least partially filling an inside of a liquid dispensing device with liquid, wherein the liquid contains an air bubble;

positioning the at least partially filled liquid dispensing device and a liquid adsorbing material in a vapor barrier bag, wherein the adsorbing material is to adsorb at least a predetermined amount of the liquid and mitigate a pressure differential between an internal pressure of the at least partially filled liquid dispensing device and an ambient pressure surrounding the vapor barrier bag; and sealing the vapor barrier bag to form a packaged liquid dispensing device.

13. The method of claim 12, comprising unpacking the packaged liquid dispensing device, wherein prior to unpacking the air bubble has expanded.

14. The method of claim 13, wherein a pressure of the air bubble in the liquid is comparatively lower during unpacking than a pressure of the air bubble when the liquid dispensing device is positioned in the vapor barrier bag.

* * * * *